United States Patent [19]

Workman

[11] 4,418,866

[45] Dec. 6, 1983

[54] HEAT RECOVERY

[76] Inventor: Theodore W. Workman, P.O. Box 828, Parsons, Kans. 67357

[21] Appl. No.: 312,544

[22] Filed: Oct. 19, 1981

Related U.S. Application Data

[63] Continuation-in-part of Ser. No. 158,527, Jun. 11, 1980, abandoned.

[51] Int. Cl.[3] ..... F24B 7/00

[52] U.S. Cl. ..... 237/55; 126/99 D; 165/DIG. 2

[58] Field of Search ..... 237/55; 165/DIG. 2; 126/112, 99 R, 99 A, 99 C, 99 D, 110 R, 110 AA, 117, 108; 122/20 B

[56] References Cited

U.S. PATENT DOCUMENTS

| | | | |
|---|---|---|---|
| 1,984,949 | 12/1934 | Smith | 237/55 |
| 2,269,055 | 1/1942 | Gower | 237/55 |
| 2,439,109 | 4/1948 | Stout | 237/55 |
| 2,902,265 | 9/1959 | Dubovick | 237/55 |
| 2,962,218 | 11/1960 | Dibert | 237/55 |
| 3,934,798 | 1/1976 | Goldsmith | 165/DIG. 2 |
| 4,044,950 | 8/1977 | Engeling | 165/DIG. 2 |
| 4,090,474 | 5/1978 | Kaufmann | 122/20 B |
| 4,138,062 | 2/1979 | Graden | 237/55 |
| 4,147,303 | 4/1979 | Talucci | 126/99 D |
| 4,176,787 | 12/1979 | Gary | 237/55 |

*Primary Examiner*—Daniel J. O'Connor

[57] ABSTRACT

A safe, practical and inexpensive method for saving heat units on modern forced warm air heating furnaces, this method employs a heat exchanger designed by the furnace manufacturer to fit each different size and type of their models. The heat exchanger is interposed directly on the furnace heat exchanger outlet and on through the piping to the flue or chimney. Air circulation through the heat exchanger is provided by the furnace blower by directing air from the warm air supply plenum, with its positive pressure, through the heat exchanger and terminating in separate supply run with a high volume of air which requires no external power to accomplish it. The heat exchanger will be provided with test openings for thermometer readings at the inlet and outlet of flue gas travel through the exchanger. A manual damper may be locked into proper position to restrict air circulation flow if necessary to maintain proper flue gas exit temperature. A down draft divertor or barometric shall be placed into proper position between the secondary heat exchange and the flue or chimney.

3 Claims, 1 Drawing Figure

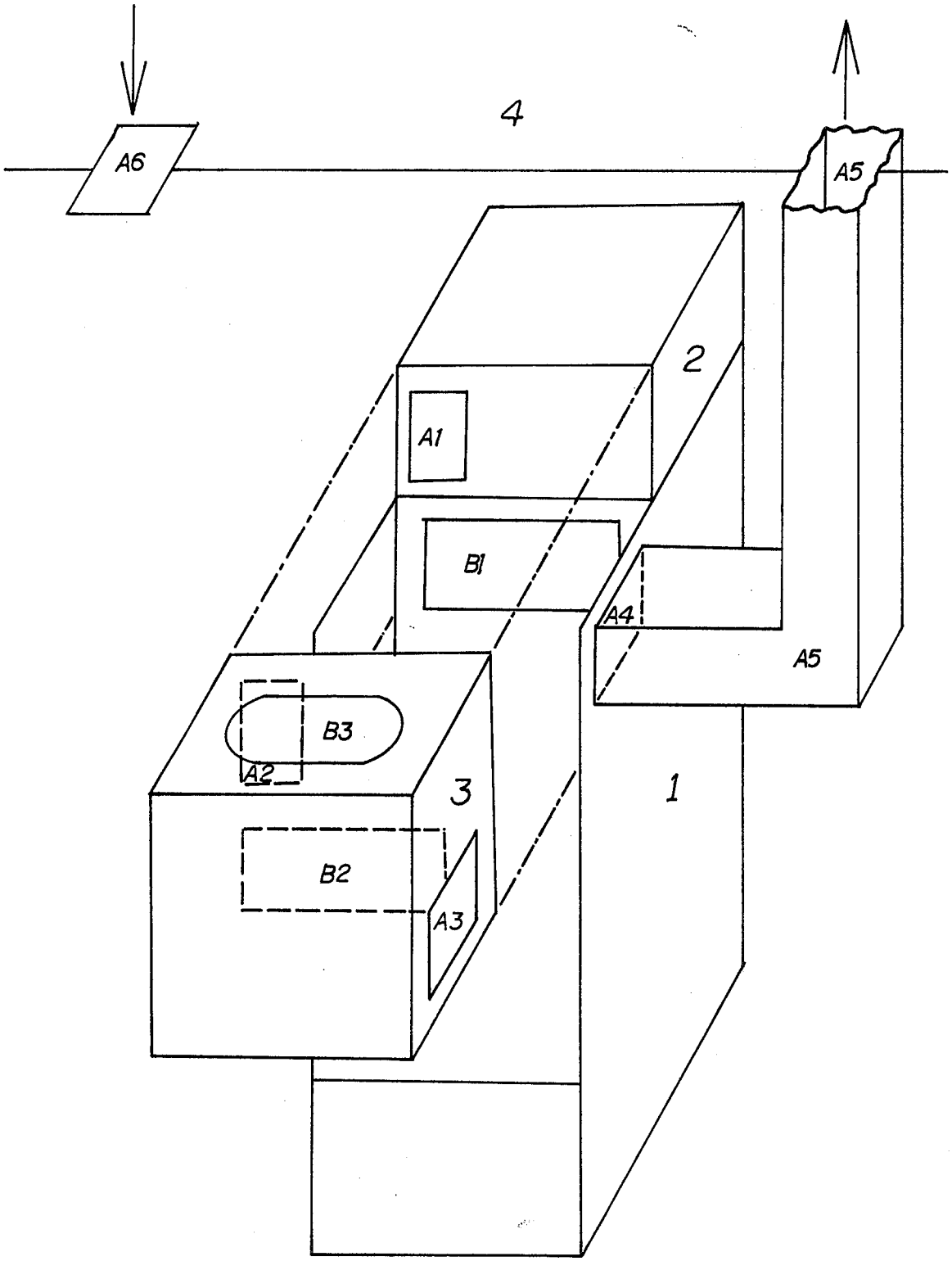
4
A6
A5
2
A1
B1
A4
A5
B3
A2
3
1
B2
A3

HEAT RECOVERY

This application is a continuation-in-part of my copending application entitled Method of Improvement on Heat Recovery that I filed on June 11, 1980 which bears application Ser. No. 158,527, now abandoned.

CROSS REFERENCES

Use of heat exchangers is well known and have been in practical use for a period of time. Some use external power (pumps, fans, blowers) to move liquids or gases to points of useable purposes. Some like metal drums on top of old wood, coal and oil burning space heaters were used to heat space adjacent only to space heater and did not normally use external power.

My method of improvement in heat recovery will make it possible to use heat units from a secondary heat exchanger for further use in forced warm air heating systems to increase efficiency and lower flue gas temperature without use of external power.

SUMMARY OF INVENTION

This method is primarily to be used in residental and small commercial forced warm air supply systems circulating air from the fan or blower (which is normally enclosed in furnace enclosure) which provides positive air circulation through added secondary heat exchanger (Flue gas to circulating air) mounted or attached directly to Flue gas outlet of furnace primary heat exchangers. Down draft diverter or barameteric damper to be installed in Flue gas outlet of added secondary heat exchanger as used in normal procedure. Air will be forced through secondary heat exchanger by positive pressure of air delivered from furnace fan or blower with its air temperature approximately two to three hundred degrees below that of Flue gas from primary heat exchanger, resulting in heat transfer to forced circulating air. Positive air after it passes through secondary heat exchanger may then be directed through separate supply run to occupied space for heating purposes. An alternative is to direct the pressurized air to exit into the return air system where it will partially preheat it.

DESCRIPTION OF VIEW OF DRAWING

The drawing attached shows an exploded view of the components of the system of the present invention. Information of reference numerals and letters where shown on drawing 1 (drawing not to scale) is as follows:

Numeral 1

Typical forced warm air heating furnace with its normal down draft equipment (draft diverter) removed. (Return air opening not shown).

Numeral 2

Added sub base to normal supply air outlet at top of typical furnace to allow opening A 1 for circulation of air to secondary heat exchanger 3.

Numeral 3

Secondary heat exchanger (Flue gas to circulating air) shown extended for clarity. Size, shape, and capacity to be designed by furnace manufacturer in assembling as adapted to their furnaces.

Numeral 4

Room space that has outlet A 5.

Symbol A

A 1 indicates opening for air delivery from furnace supply air from sub base 2 to secondary heat exchanger 3 opening.

A 2 indicates opening in secondary heat exchanger 3 to receive air supply from A 1.

A 3 indicates outlet opening of air supply after it passes through heat exchanger 3. This air supply may be used for separate supply run for heating purposes.

A 4 indicates where air supply may leave furnace from A3.

A 5 indicates separate supply run to room space from A3.

A 6 indicates opening for return of circulating air to furnace return air system from A5.

Symbol B

B 1 indicates outlet of flue gas from warm air furnace primary heat exchanger.

B 2 indicates opening in secondary heat exchanger 3 to receive flue gas as it exits from furnace's primary heat exchanger.

B 3 indicates opening in secondary heat exchanger 3 for flue gas to exit after passing through secondary heat exchanger 3. Flue gas then may continue normal course through down draft equipment (if required) to exit into flue or chimney.

All openings indicated in Drawing may be rectangular, oval or round.

DETAILED DESCRIPTION

In a thermostatically controlled forced warm air furnace; the fuel in the combustion chamber is ignited on call for heat from the thermostat. When the primary heat exchanger warms up to a predetermined temperature, the controls start a blower fan to produce positive circulation of air through the primary exchanger to supply air plenum from where it is distributed for further use in heating. After the thermostat is satisfied it shuts off the fuel supply through controls.

Blower fan will keep on operating and cooling down the heat exchanger until a predetermined temperature will shut off power to the blower fan thus using residuel heat left in the primary heat exchanger.

Heat and products of combustion travel from combustion chamber through the primary heat exchanger to its flue gas outlet, where it is protected by down draft equipment before flue gas travels on its way to the flue or chimney.

The temperature of the flue gas before it enters the down draft equipment is normally between 400° F. to 500° F. and may run higher in some furnaces. The supply plenum which is mounted on the furnace supply air outlet, receives pressure and air from the blower fan at temperatures usually starting at 120° F. and ending at 170° F. (Controls shut off above predetermined temperature).

In this system a secondary heat exchanger is mounted as closely as possible on the furnace primary heat exchanger outlet, with its exit connected to flue through down draft equipment. By directing air from the furnace outlet supply air through secondary heat exchanger, exit temperature of the supply air from secondary heat exchanger will be raised and flue gas exit temperature will be lowered, thus resulting in savings of heat units that were going to flue. Exit of supply air from heat exchanger may be directed to a separate supply run to heat occupied room space. This system does not use any external force or power to make it operate using only pressurized air from the supply system.

This system has a "built in" flue gas exit temperature safety factor.

Maximum heat is transfered when flue gas exit temperature (through secondary heat exchanger) is 400° to 500° F. As the temperature drops there is less temperature difference between flue gas and circulating air in the secondary heat exchanger, thus limiting further drop in flue gas exit temperature from the secondary heat exchanger and helping keep flue gas exit temperatures safer.

In this system I would prefer that furnace manufacturer or their assembler to size, design, and fabricate the secondary heat exchanger for their different models and fuel input with proper fitting and sealing of flue gas and circulating air parts.

Test holes may be provided in the secondary heat exchanger at inlet and outlet of flue gas travel. A damper will be provided in circulating air path if it is needed.

I claim:

1. In a room space heating method wherein air is cyclically blown from an initial position into and through a furnace heating zone and thence passing as heated air along a heated air path to enter a room space, with air from the room space passing along a return path to the initial position, and wherein air is heated in the furnace heating zone by heat exchange with a furnace combustion zone with combustion products produced in the latter being vented to atmosphere along a flue gas path, the improvement comprising diverting a portion only of the heated air passing along the heated air path to pass along a separate auxiliary heated air path to enter a room space, and effecting a heat exchange between combustion products traveling along the flue gas path with diverted heated air traveling along the auxiliary path, whereby a portion of the furnace heated air is diverted from passing to the room space to pass in heat exchange relation with hot combustion products for additional heating prior to entering a room space, wherein the separate auxiliary heated air path comprises a secondary heat exchanger at an upper side part of said furnace, wherein said furnace includes a base portion (2) at the top thereof having an opening (A1) in a side wall, said furnace further including a secondary heat exchanger (3) having an opening (A2) in a side wall to receive air from said base portion, said furnace having a flue gas outlet (B1) in a side wall thereof to receive flue gas from a primary heat exchanger, said secondary heat exchanger further including an opening to receive flue gas (B2) in a side wall thereof and an opening to exit flue gas in a top wall (B3) thereof, said secondary heat exchanger further including an opening (A3) in a side wall thereof wherein heated air is supplied to a supply run (A5), wherein the heated air and the auxiliary heated air paths direct heated air entry into the room space at positions remote from each other.

2. The method of claim 1, wherein said room spaces constitute a single room space.

3. The method of claim 1, together with the step of controlling the relative air flow along the hot air and auxiliary paths.

* * * * *